US005692466A

United States Patent [19]

Hausmann et al.

[11] Patent Number: 5,692,466

[45] Date of Patent: Dec. 2, 1997

[54] COMPONENT SUPPORT ARRANGEMENT FOR AN INTERNAL COMBUSTION ENGINE

[75] Inventors: Gerhard Hausmann, Leinfelden; Horst Hirschberger, Stuttgart, both of Germany; Hans Schwiedessen, Portland, Oreg.; Gerhard Hövelmann, Weinstadt, Germany

[73] Assignee: Mercedes-Benz AG, Stuttgart, Germany

[21] Appl. No.: 752,855

[22] Filed: Nov. 21, 1996

[30] Foreign Application Priority Data

Nov. 21, 1995 [DE] Germany ..... 195 43 350.5

[51] Int. Cl.[6] ..... F02F 7/00

[52] U.S. Cl. ..... 123/195 A; 123/195 C

[58] Field of Search ..... 123/195 C, 198 E, 123/195 A

[56] References Cited

U.S. PATENT DOCUMENTS 4,998,515 3/1991 Carvalho ..... 123/195 C

FOREIGN PATENT DOCUMENTS 28 54 992 7/1980 Germany .

29 51 961 7/1980 Germany .

*Primary Examiner*—Noah P. Kamen

*Attorney, Agent, or Firm*—Klaus J. Bach

[57] ABSTRACT

In a component support arrangement for mounting auxiliary components such as an alternator, a power steering pump and an air conditioning compressor to an engine, the component support arrangement consists of a crank shaft drive cover mounted on the front of the engine and including a reinforcement structure disposed on the inside of the camshaft drive cover between reception structures for the auxiliary engine components and comprising ribs and webs which extend transversely between the reception structures and are connected thereto.

5 Claims, 2 Drawing Sheets

COMPONENT SUPPORT ARRANGEMENT FOR AN INTERNAL COMBUSTION ENGINE

BACKGROUND OF THE INVENTION

The invention relates to a component support arrangement for an internal combustion engine, the component structure being firmly attached at one end that is at the front of the engine and supporting auxiliary engine components such as the alternator, the power steering pump and the a/c compressor.

DE 28 54 992 A1 discloses a typical component bracket for an internal combustion engine. The essentially plate-like component bracket is mounted on one side at the front of the engine block as a separate part and supports the auxiliary components which are driven by a belt from the crankshaft. For this purpose, a drive pulley fixed to the crankshaft is supported in the component bracket.

For general technical background, reference is further made to DE 29 51 961 A1.

It is the object of the present invention to provide a component support arrangement which will reduce production costs and simplify assembly.

SUMMARY OF THE INVENTION

A component support arrangement for mounting auxiliary components such as an alternator, a power steering pump and an air conditioning compressor to an engine includes a crank shaft drive cover mounted on the front of the engine. The crankshaft drive cover is provided with a reinforcement structure disposed on the inside of the camshaft drive cover between reception structures for the auxiliary engine components. It comprises ribs and webs which extend transversely between the reception structures and are connected thereto.

Truss-like reinforcements are arranged on the camshaft drive cover, between the mounts for the auxiliary components. As a result, the auxiliary components can be rigidly mounted directly on the camshaft drive cover. The component support bracket as usually used can therefore be omitted, whereby the costs of assembly are reduced while a considerable amount of weight is saved as well. The arrangement and design of the support structure provide also for a good reaction force transmission from the components by way of the camshaft drive cover to the engine block.

Another advantage of the component support arrangement according to the invention is that the resonance frequency of the camshaft drive cover is increased which greatly reduces vibration of the components and decreases engine noise during engine operation.

The support arrangement includes further an open space disposed within the camshaft drive cover for accommodating the camshaft drive, that is, a timing chain. The timing chain extends vertically at the front end of the engine block. The whole arrangement simplifies the cast structure for the front face of the engine block.

Preferably, some of the components are arranged in the side edge regions on the outside of the camshaft drive cover. Then the adjacent flanges of the camshaft drive cover transfer the reaction forces directly to the engine block whereby bending stresses on the camshaft drive cover are relatively small.

Also, the eye structures provided in the cam shaft drive cover for receiving the bolts for mounting the camshaft drive cover are integrated into the support structure so as to further stiffen the camshaft drive cover.

More details and advantages of the invention are described in greater detail below on the basis of the accompanying drawing.

DESCRIPTION OF A PREFERRED EMBODIMENT

Figure 1:
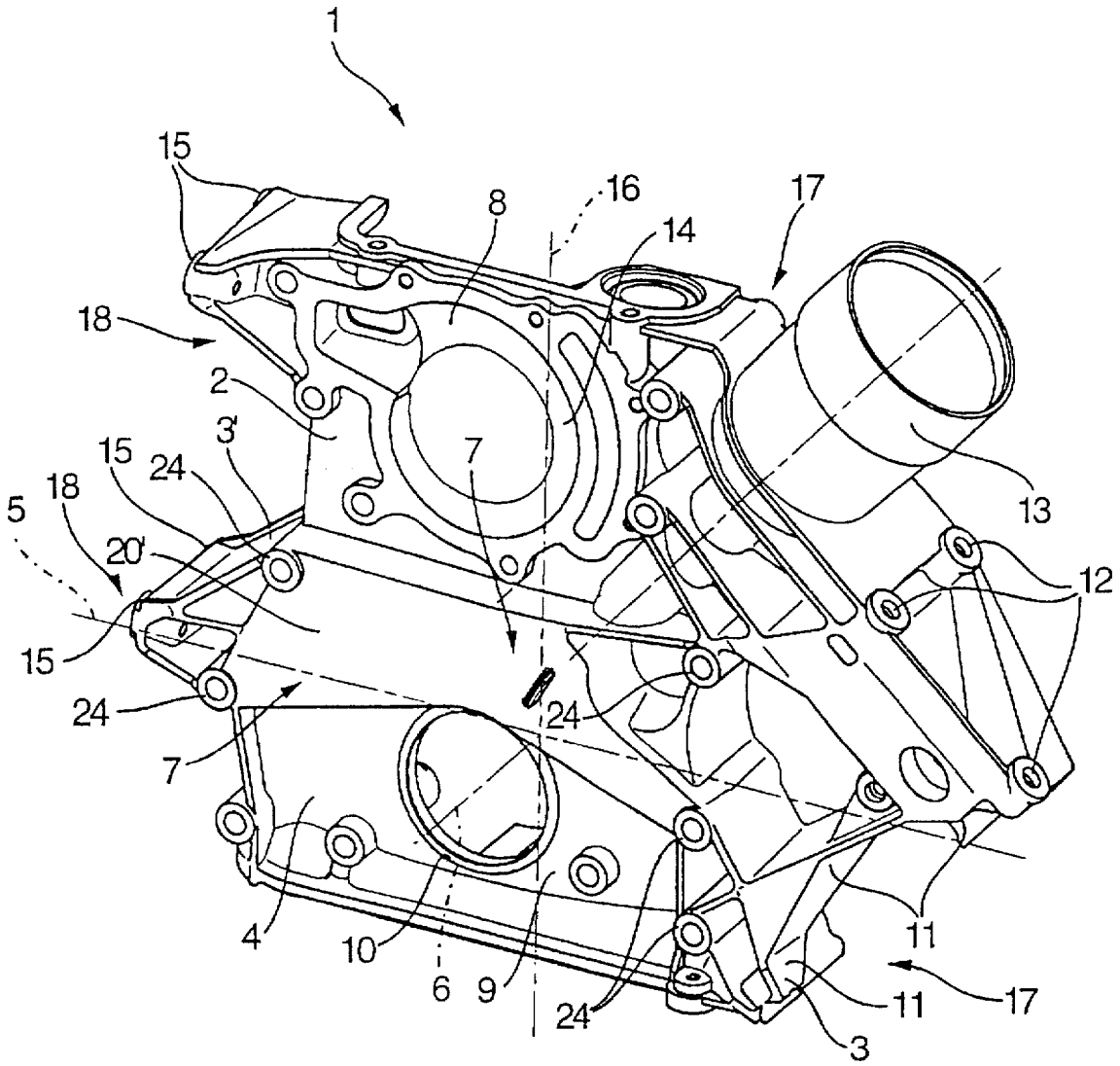
FIG. 1 is a perspective front view of a cam shaft drive cover for an engine which includes structural means for supporting auxiliary engine components and reinforcement structures extending between the structural support means.

FIG. 1 shows a camshaft drive cover 1 of an internal combustion engine which also serves as an auxiliary component support structure. The camshaft drive cover 1 is mounted on the front end of the internal combustion engine to cover the drive for the camshaft which is not shown in the drawings.

The single unit camshaft cover 1 is adapted to support auxiliary engine components which are not shown but which will be described below in greater detail. It comprises a front plate 2 which is spaced from the front end of the engine block and extends essentially parallel to the engine block front end side. Web walls 3, 3' with seal surfaces 2*a*, *a*' (see FIG. 2) extend normal to the front plate 2. The camshaft cover 1 is mounted onto the front end side of the engine block by way of the web walls 3, 3'.

The camshaft cover 1 is provided with a shoulder portion 20' of a mounting area 7 which is raised in the direction of the longitudinal axis of the engine. It extends, on the outside of the camshaft cover 1, in the direction of a lateral axis 5. The raised mounting area 7 divides the shaft cover 1 into an upper part 8 and a lower part 9.

The camshaft cover 1 includes reception areas 11–15 for mounting the auxiliary components. The lower part 9 of the camshaft cover 1 includes in its center a circular receiver opening 10 with a reinforced rim through which an axial extension of a drive pulley extends (not shown) and is operatively connected to the engine drive shaft for rotation therewith. The pulley serves to drive all the auxiliary components mounted on the camshaft drive cover 1. A seal, provided between the pulley extension and the receiver opening 10 seals the space enclosed by the camshaft drive cover.

The half-moon-shaped reception area 11 is arranged, as shown in FIG. 1, on the right of the receiver openings 10. It is adapted to receive an air conditioning compressor which is mounted on the side of the camshaft drive cover 1 adjacent the web wall 3.

The cam shaft drive cover 1 includes a reception area 12 in the form of a three point support for mounting a power steering pump. The reception area 12 is located in the upper part 8 of the camshaft drive cover 1 above the reception area 11 for the air conditioning compressor. The cover 1 further includes a tubular receiver 13 for an oil filter cartridge. The tubular receiver 13 is located above the reception area 12 for the power steering pump. To the left next to the receiver 13, there is a reception area 14 for a water pump. Further to the left, there is a reception area 15 for supporting an alternator on the side of the camshaft drive cover 1 adjacent its web wall 3'.

The reception areas 11 to 13 and the reception area 15 for the auxiliary components are arranged in two outer areas 17, 18 extending in the direction of a vertical axis 16 of the engine at the outside 4 of the camshaft drive cover 1. The outer area 17 indicated by lead lines with arrows extends along the right side (reception 11–13) of the front plate 2. The outer area 18, which is also indicated by lead lines with arrows, is disposed at the left side (reception 15) of the front plate 2 of the camshaft drive cover 1. The side web walls 3, 3' adjoining the front plate 2 extend in the direction toward the engine block. They act, on one hand, as reinforcement ribs, and on the other hand, transmit forces generated by the auxiliary components directly to the engine block, such that bending stresses on the camshaft drive cover 1 remain relatively small.

Figure 2:
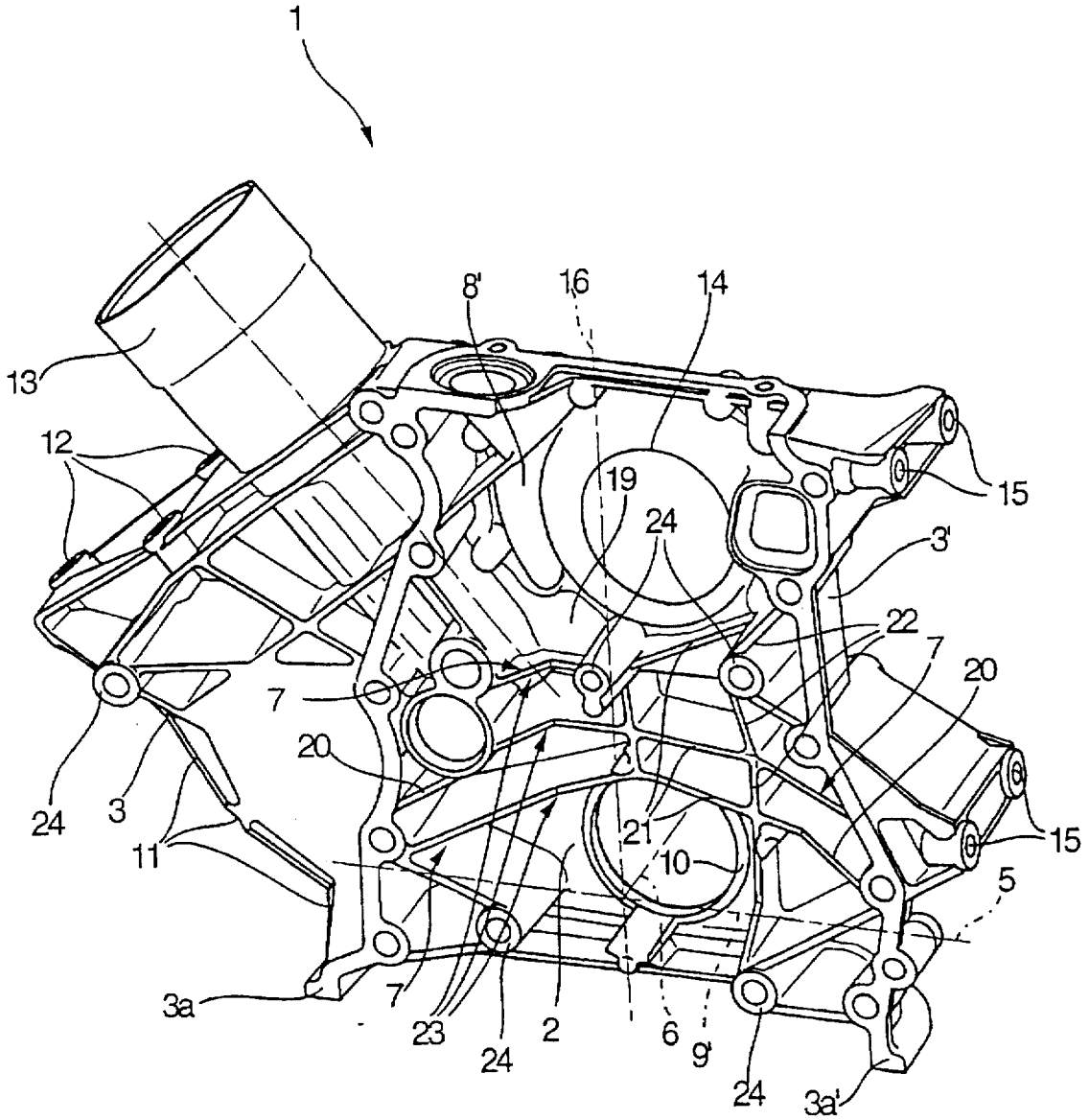
FIG. 2 is a perspective view of the camshaft drive cover as seen from the engine side of the camshaft drive cover where the truss-like reinforcement structures are visible.

FIG. 2 is a perspective view showing the inside 19 of the camshaft drive cover 1. In order to increase the rigidity and the resonance frequency of the camshaft drive cover 1, it is reinforced on the inside by a reinforcement rib structure 23. The reinforcement rib structure 23 divides the camshaft drive cover 1 also at its inside into an upper part 8' and a lower part 9'. A part 20 of the lattice-like reinforcement rib structure 23 disposed at the inside 19, is limited at the outside 4 of the camshaft drive cover 1 by the shoulder portion 20' (see FIG. 1) of the mounting area 7. The mounting area 7 includes transverse ribs 21 and webs 22 which extend lattice-like between the receiver areas 11–15 for the auxiliary components. They are connected to the receiver area structures 11–15. The transverse ribs 21 and the webs 22 provide for an extremely stiff camshaft cover 1, which transmits forces applied thereto by the auxiliary components mounted thereon directly to the engine block. Any bending forces generated by the forces transmitted to the camshaft drive cover 1 by the auxiliary components are compensated for particularly by the lateral ribs 21 and the webs 22.

For an optimal utilization of the available space the inside 19 of the camshaft drive cover 1 includes an open area 23 extending essentially in the direction of the vertical axis 16. The open area 23 is disposed between the outer areas 17, 18 for receiving the auxiliary components and is adapted to receive the camshaft chain drive (not shown). The open area is provided by recesses formed in the transverse ribs 21 and the webs 22 of the mounting area 7.

the ribs and webs of the mounting area 7 are formed integrally with tubular channels receiving the mounting bolts for mounting the camshaft drive cover 1 to the engine block. This arrangement provides for further stiffening of the camshaft drive cover 1. Gaskets are disposed between the seal surfaces **3*a*, 3*a'* of the web walls 3, 3'** and the engine block when the camshaft drive cover is mounted to the engine block.

Of course, there may be other receiving areas provided on the camshaft drive cover. In addition, at least one belt tensioning device may be mounted on the camshaft cover whereby the belt or belts driving the auxiliary components can be kept properly tensioned.

What is claimed is:

1. A component support arrangement for mounting auxiliary components including an alternator, a power steering pump and air conditioning compressor, to an internal combustion engine with a front end and a camshaft drive disposed on the engine front end, said component support arrangement comprising a camshaft drive cover for mounting on the front end of said engine to cover said camshaft drive, said camshaft drive cover including reception structures for supporting auxiliary engine components and a reinforcement structure disposed on the inside of said camshaft drive cover facing said camshaft drive between said reception structures and comprising ribs and webs extending transversely between said reception areas and being connected thereto.

2. An arrangement according to claim 1, wherein said camshaft drive cover includes, at its inside a recessed area extending in the direction of an upright axis of said cover for accommodating a drive chain or belt for driving the camshaft of said engine.

3. A component support arrangement according to claim 2, wherein reception structures for said auxiliary components are arranged on top of one another at opposite outer side areas of said camshaft drive cover and said recessed area for accommodating said drive chain or belt is disposed between said outer areas.

4. A component support arrangement according to claim 1, wherein said camshaft drive cover includes eye structures with openings for receiving mounting bolts for mounting said camshaft drive cover to said engine, said eye structures and said ribs and webs being joined and integrally formed with said camshaft drive cover for reinforcement of said camshaft drive cover.

5. A component support arrangement according to claim 1, wherein said camshaft drive cover includes at least one means for supporting a belt tensioner.

* * * * *